US006098973A

United States Patent [19]

Khachatoorian

[11] Patent Number: 6,098,973

[45] Date of Patent: Aug. 8, 2000

[54] C-CLAMP

[75] Inventor: Zareh Khachatoorian, City of Industry, Calif.

[73] Assignee: Olympia Industrial, Inc., City of Industry, Calif.

[21] Appl. No.: 09/046,081

[22] Filed: Mar. 23, 1998

[51] Int. Cl.[7] ..... B25B 1/02

[52] U.S. Cl. ..... 269/182; 269/249

[58] Field of Search ..... 269/181–182, 269/173–174, 249

[56] References Cited

U.S. PATENT DOCUMENTS

| | | | |
|---|---|---|---|
| 236,239 | 1/1881 | Morris | 269/181 |
| 1,452,384 | 4/1923 | Kissendorfer . | |
| 1,543,197 | 6/1925 | Ulrich . | |
| 2,133,892 | 10/1938 | Gelinski . | |
| 2,156,195 | 4/1939 | Robillard . | |
| 2,218,319 | 10/1940 | Pfauser | 269/182 |
| 2,461,687 | 2/1949 | Hopfeld | 269/182 |
| 2,546,336 | 3/1951 | Gibbons . | |
| 2,636,528 | 4/1953 | Golnick | 269/182 |
| 2,644,498 | 7/1953 | Malecki | 269/182 |
| 3,079,141 | 2/1963 | Malesko | 269/182 |
| 4,534,547 | 8/1985 | Cox . | |
| 4,582,307 | 4/1986 | Wang . | |
| 5,568,916 | 10/1996 | Gibbons et al. . | |

*Primary Examiner*—Robert C. Watson
*Attorney, Agent, or Firm*—James E. Brunton, Esq.

[57] ABSTRACT

A clamping device including a generally C-shaped frame having first and second ends. The first end of the C-shaped frame is uniquely provided with a first through bore and a second angularly extending bore. The device further includes an elongated threaded rod having an external thread and being telescopically movable within the through bore. A novel control member having a rack-like upper surface is disposed within the second bore of the C-clamp frame for movement into and out of the engagement with the threaded rod in response to manual force exerted on the control member and also in response to forces exerted on the out-board end of the threaded rod urging it in a direction toward engagement with the work piece.

12 Claims, 3 Drawing Sheets

C-CLAMP

BACKGROUND OF THE INVENTION

1. Field of the Invention

The present invention relates generally to clamping devices. More particularly, the invention concerns a quick set and release C-clamp.

2. Discussion of the Prior Art

C-clamps are old in the art. The conventional C-clamp comprises a generally C-shaped frame having a first end provided with a threaded bore and a second, opposite end provided with a flat, object engaging surface. An elongated threaded screw is threadably relievable within the threaded bore and includes an object engaging end which cooperates with the flat object engaging surface of the C-shaped frame to clamp an article within the throat of the C-clamp. Adjustment of this common type of C-clamp is accomplished by rotating the threaded screw into and out of the threaded bore. Because screw speed is limited by the pitch of the threads formed within the threaded bore, adjustment of the conventional C-clamp is undesirably slow. For this reason a number of different types of quick set and release C-clamp constructions have been suggested.

Representative of the prior art quick set and release C-Clamps is that disclosed in U.S. Pat. No. 4,502,307 issued to Wang. The Wang device includes a C-shaped body for a screw which can adjustably penetrate through an end of the C-shaped body to clamp and release an object placed within the throat between a free end of a screw and the other end of the C-clamp, "C" shaped body. The device also includes a controlling member mounted pivotally with respect to the C-shaped body and provided with a threaded surface which can be rotated pivotally to engage or disengage with a screw. With this arrangement one can achieve either determine a fast operation mode or a normal operation mode of the C-clamp.

Another prior art quick set and release C-clamp is disclosed in U.S. Pat. No. 5,568,916 issued to Gibbons et al. This device comprises a frame having an inner leg and outer leg fixedly spaced from each other, a threaded rod freely movable through a transverse bore provided in the end portion of the inner leg; a first work piece engaging member fixedly attached to the end of the outer leg; a second work piece engaging member connected to the threaded rod; a pair of rod engagable half bodies slidable within a tapered end of the transverse bore for engaging the threaded rod; a retaining cover to house and restrict movement of the rod engaging half bodies; a detent to urge the half bodies into the seat portion of the transverse bore and to engage the threaded rod; a spring to urge the rod engagable half body slightly out of the tapered end of the transverse bore; a biased element for urging separation of the rod engagable half bodies; and a spring member to urge the detent against the cover.

While the prior art quick set and release clamping devices are clearly superior to the conventional, slow acting C-clamp, they never the less are designed so that the control element must be manually operated by the user in order to permit rapid movement of the threaded rod within the transverse bore. As will be better understood from the description which follows, the apparatus of the present invention overcomes this drawback by providing a novel control means which permits forward or closing movement of the threaded rod without manual operation of the control means or control member of the device. More particularly, the control means of the apparatus of the invention is uniquely designed so that a forward pressure exerted on the threaded rod will cause the control member to pivot downwardly to a position which permits the threads on the threaded rod to by pass the control member so that the threaded rod can be rapidly moved toward a closing position without the necessity for manual operation of the control member or rotation of the threaded rod.

SUMMARY OF THE INVENTION

It is an object of the present invention to provide a quick set and release clamping device of the character having a "C" shaped frame which includes a first end provided with a threaded bore and a threaded rod telescopically received within the through bore, which device can be operated at a fast speed.

Another object of the invention is to provide a device as described in the aforementioned character which is specially designed to allow the user to freely move the threaded rod portion of the device back and forth relative the clamping frame without having to rotate the threaded rod portion.

Another object of the invention is to provide a device as described in the preceding paragraph which includes a strategically shaped control member mounted within an angularly disposed bore formed in the C-shaped frame of the clamp which control member is movable from a first position wherein it is in operable engagement with the threaded rod, to a second position wherein it is disengaged from the threaded rod so that the threaded rod can be freely moved within the through bore between a retracted and an extended position.

Another object of the invention is to provide a device of the character described in the preceding paragraph in which an axial force exerted on the threaded rod in a first or closing direction will cause the control member to automatically move into its second disengaged position thereby permitting the threaded rod to be moved freely within the through bore in a direction toward its extended or object engaging position.

Another object of the invention is to provide a quick set and release clamping device of the class described which is durable and exhibits substantial clamping strength.

Another object of the invention is to provide a clamping device of the character described in the preceding paragraphs which is easy and efficient to use since the threaded rod can be quickly adjusted without having to rotatably thread it in and out of the clamping frame.

In summary, the clamping device of the present invention comprises a generally C-shaped frame having first and second ends. The first end of the C-shaped frame is uniquely provided with a first through bore and second angularly extending. The device further includes an elongated threaded rod having an external thread and being telescopically movable within the through bore. A novel control member having a rack-like upper surface is disposed within the second bore of the C-clamp frame for movement into and out of the engagement with the threaded rod in response to manual force exerted on the control member and also in response to forces exerted on the threaded rod urging it in a direction toward engagement with the work piece.

DESCRIPTION OF THE INVENTION

Figure 1:
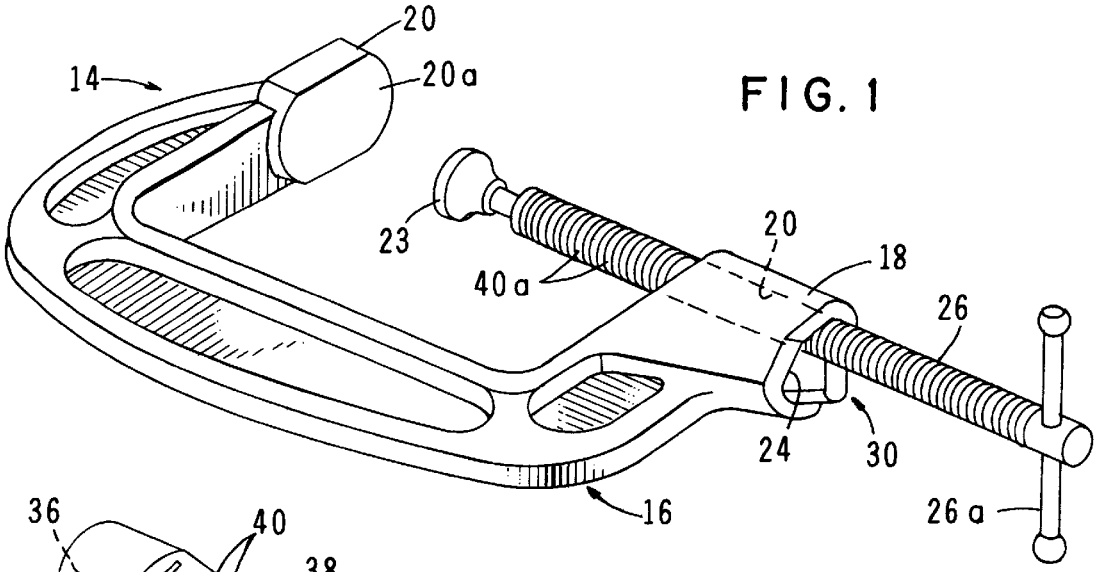
FIG. 1 is a generally perspective view of one form of the quick set and release clamping device of the present invention.
Figure 2:
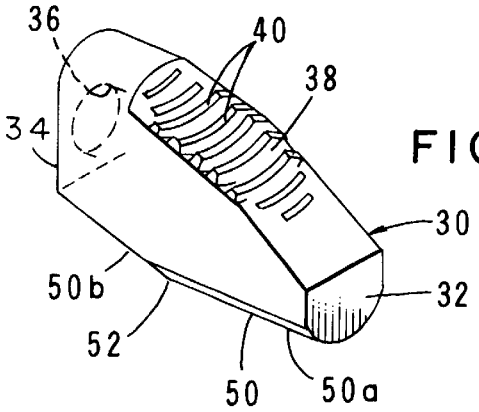
FIG. 2 is an enlarged, generally perspective view of one form of the control member of the device for controlling movement of the threaded rod.
Figure 3:
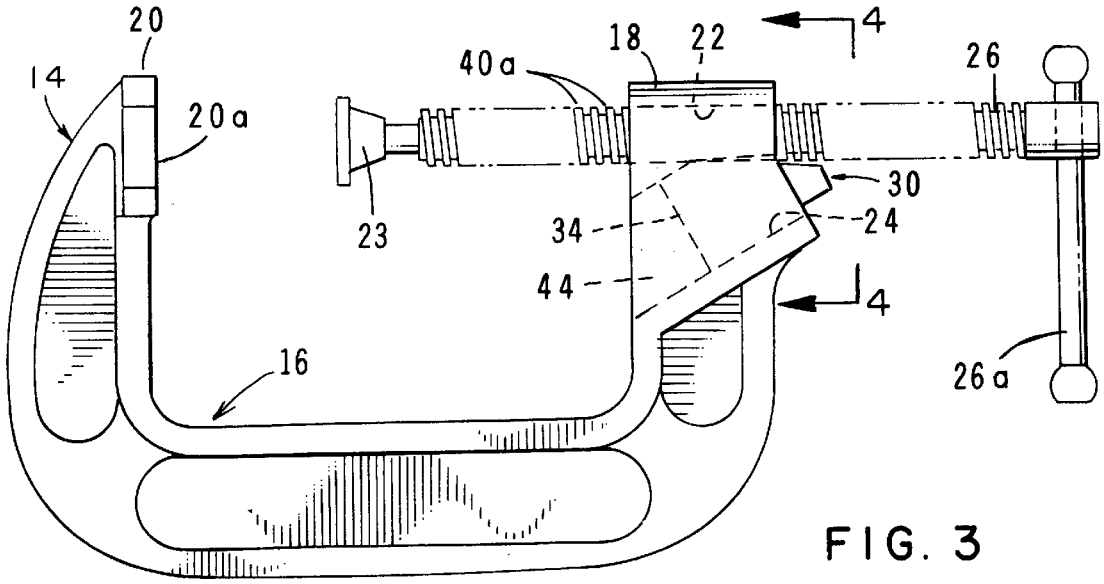
FIG. 3 is a side elevational view of the quick set and release clamping device shown in FIG. 1.
Figure 4:
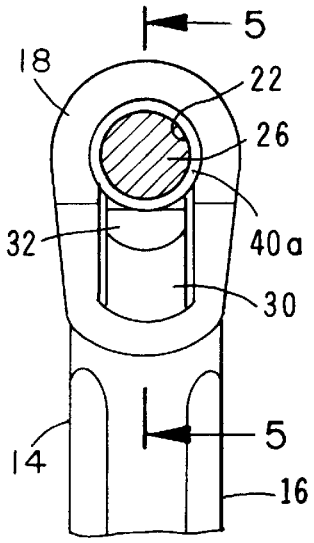
FIG. 4 is a cross-sectional view taken along lines 4—4 of FIG. 3.

Referring to the drawings, and particularly to FIGS. 1 through 3, one form of the article clamping device of the present invention for clamping a work piece between the jaws of the C-Clamp is there shown and generally designated by the Numeral 14. The device of this form of the invention comprises a generally "C" shaped frame 16, having first and second end portions 18 and 20. As best seen in FIG. 3, end portion 20 includes a work piece engaging flat 20*a*. End portion 18, on the other hand, includes a first through bore 22 and a second, angularly extending, larger diameter cavity defining bore 24, which extends angularly relative to the axis of through bore 22. A threaded rod 26 is receivable through bore 22 for telescopic movement therewithin between a first retracted position and a second extended position.

Figure 5:
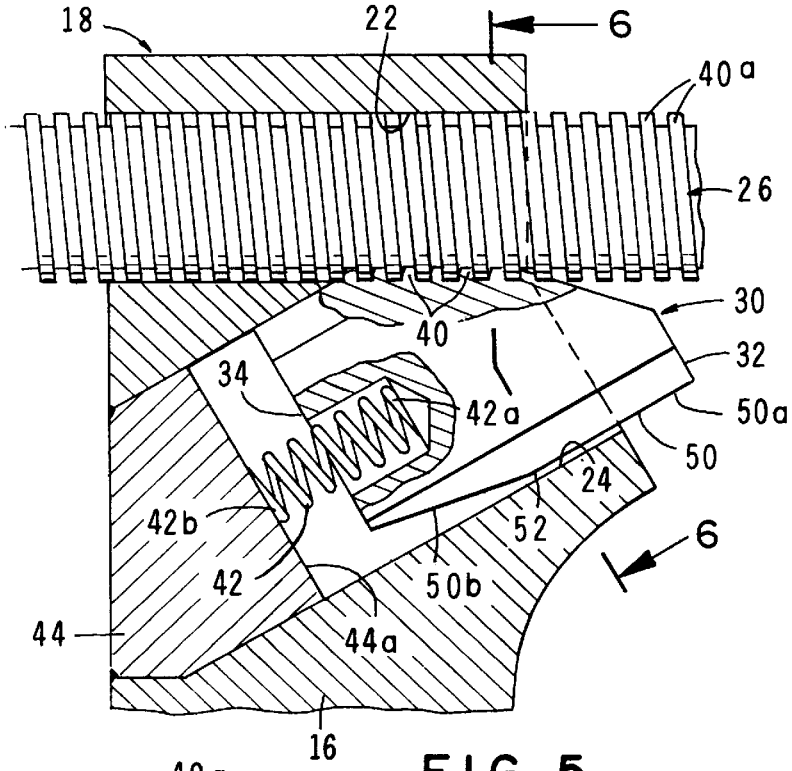
FIG. 5 is an enlarged, cross-sectional view taken along lines 5—5 of FIG. 4.

Provided at the inboard end of rod 26 is a work piece engaging swivel 23. Forming an extremely important aspect of the apparatus of the invention is control means for controlling movement of the threaded rod 26 within through bore 22. This important control means here comprises a control member 30 which is pivotally carried within the upper portion of bore 24 for pivotal movement between a threaded rod engaging position and a rod disengaging position. As shown in FIG. 5, control member 30 includes first and second generally parallel, spaced apart end walls 32 and 34 respectively. End wall 34 is provided with a counter bore 36 the purpose of which will presently be described. Extending between end walls 32 and 34 is a rack-like, rod engaging surface 38 which is provided with a plurality of tooth like protuberances 40. (See also FIG. 2)

Figure 9:
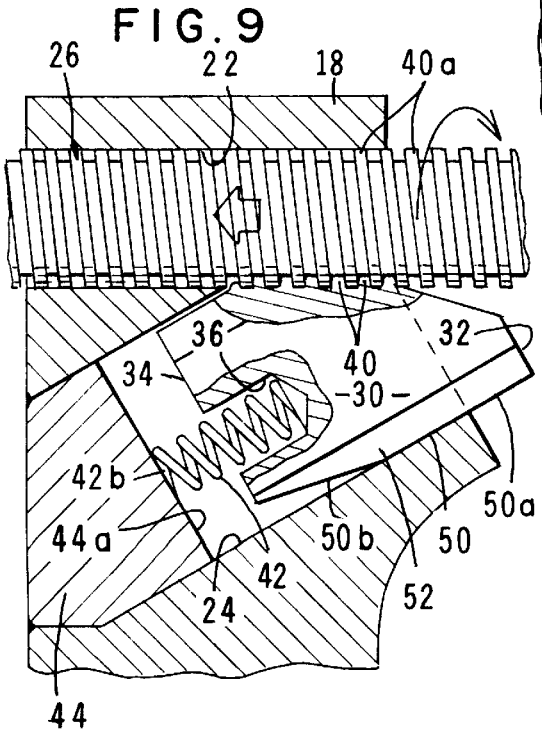
FIG. 9 is an enlarged fragmentary cross-sectioned view illustrating normal tightening of the threaded member against the work piece.
Figure 10:
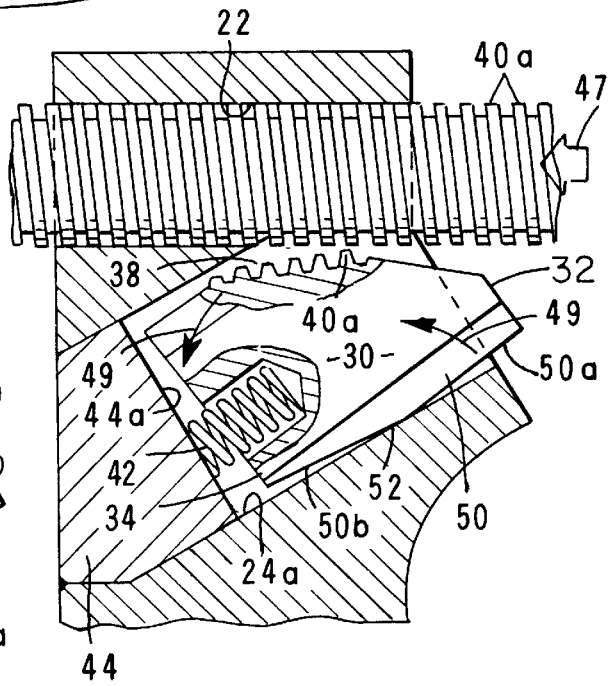
FIG. 10 is an enlarged fragmentary cross-sectional view similar to FIG. 9, but illustrating the method of operating the control member to enable rapid forward movement of the threaded rod without the necessity of moving the control member with the fingers of the user.

Disposed within counter bore 36, is a biasing means for yieldably resisting movement of control member 30 from a threaded rod engaging position into a disengaged position as shown in FIG. 10. This biasing means is here provided in the form of a coil spring 42 one end of which, 42*a* seats within counter bore 36 and the other end of which 42*b* engages the top wall 44*a* of stop member 44 which is disposed within bore 24. As indicated in FIG. 9, the biasing means or coil spring 42 continuously urges member 30 outwardly of counter bore 24 in a manner to urge teeth 40 provided on surface 38 into threadable engagement with teeth 40*a* provided on threaded rod 26.

Figure 7:
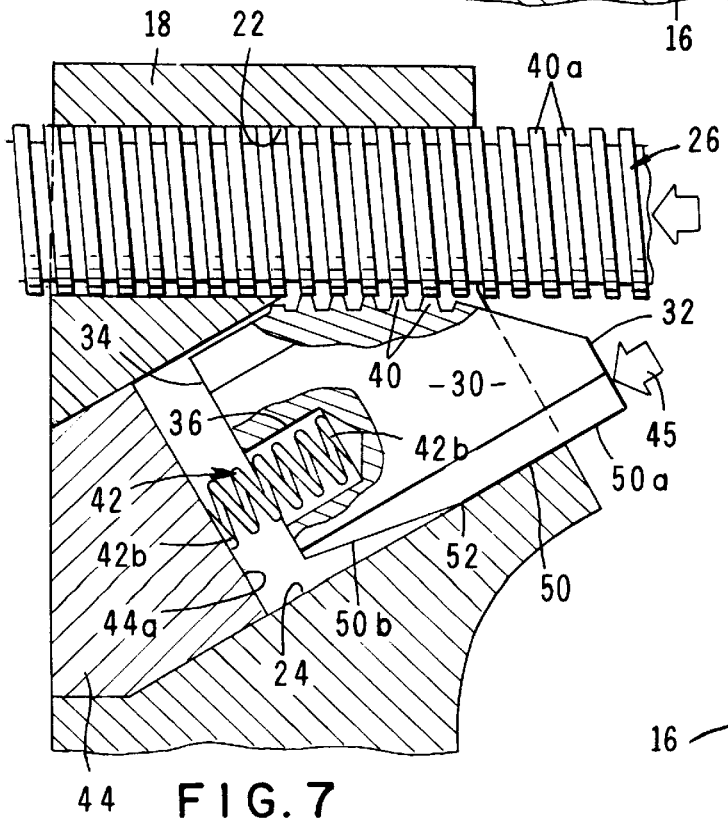
FIG. 7 is a fragmentary, side-elevational, cross-sectional view similar to FIG. 5, but showing the control member in a disengaged, quick release position to enable forward and rearward movement of the threaded rod.
Figure 6:
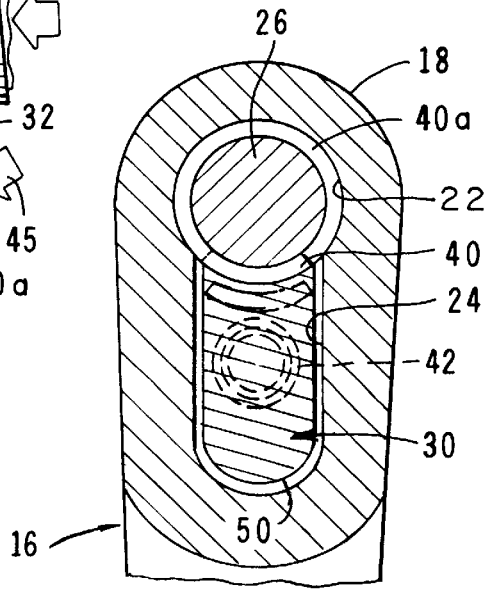
FIG. 6 a cross-sectional view taken along lines 6—6 of FIG. 5.
Figure 8:
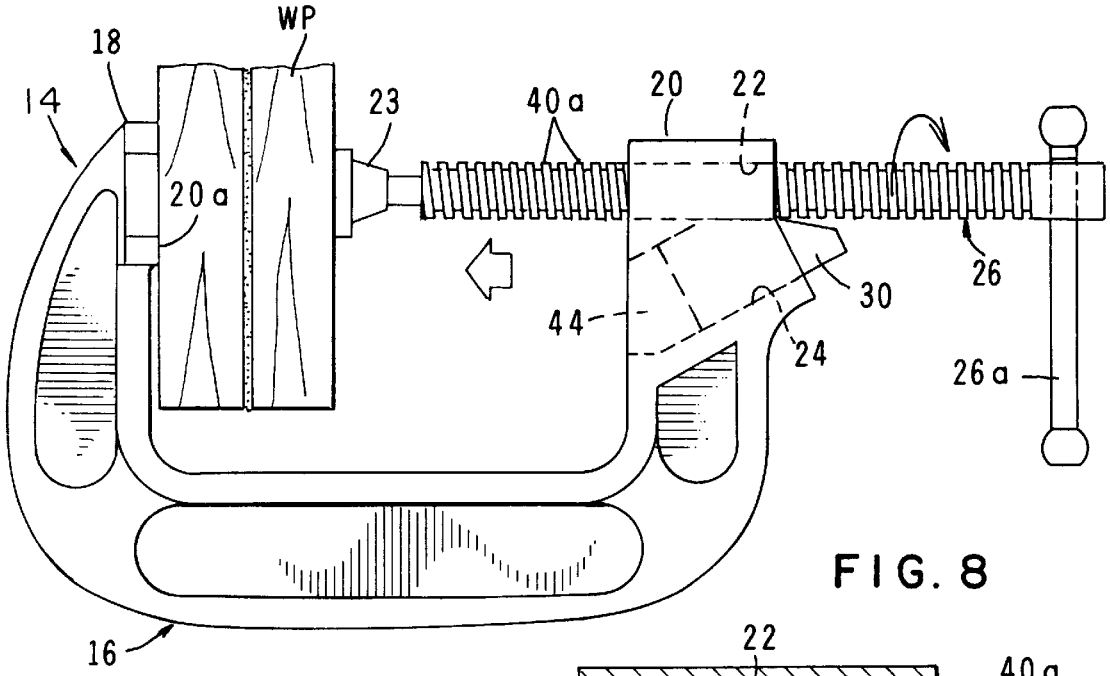
FIG. 8 is a side elevational view similar to FIG. 3, but showing the work piece clamped within the jaws of the clamping device.

With the component parts of the apparatus in the position shown in FIGS. 5 and 9, a clockwise rotation of threaded rod 26 using finger engaging handle 26*a* (FIG. 1), will cause the threaded rod to move toward an extended position and into pressural engagement with the work piece (WP) in the manner shown in FIG. 8. However, as shown in FIG. 7 when an inward force is directed against member 30 in the direction arrow 45 of FIG. 7, member 30 can be urged inwardly lineraly downwardly against the urging of Spring 36 to the position shown in FIG. 7 where teeth 40 of member 30 have moved out of engagement with teeth 40*a* of threaded rod 26. As member 30 moves inwardly, the lower surface of the member will slide along the inner surface of bore 24. It is apparent that with the component parts are in the position shown in FIG. 7 threaded rod 26 can be moved freely, inwardly and outwardly of through bore 22. Of course, when finger pressure is released against member 30, spring 42 will urge the member to return into the thread engaging position shown in FIGS. 5 and 9 where movement of the threaded rod 26 can be accomplished by rotation of rod 26 using handle 26*a*.

An extremely important aspect of the apparatus of the present invention is illustrated in FIG. 10. As depicted in this Figure, a force exerted against rod 26 in the direction of the Arrow 47, will cause member 30 to move in a pivotal direction indicated by the arrows 49 in FIG. 10 so that as the member pivots teeth 40 on member 30 will move away from and out of engagement teeth 40*a* provided on rod 26. This will of course permit a free forward sliding movement of rod 26 within through bore 22 in a direction toward the work piece WP, that is toward the extended position shown in FIG. 8.

It is to be observed that control member 30 includes a bottom wall 50, which interconnects first and second end walls 32 and 34. Bottom wall 50 includes first and second angularly inclined surfaces 50*a* and 50*b*. Surfaces 50*a* and 50*b* cooperate to define a fulcrum 52 about which member 30 pivots upon an inward force being exerted on threaded rod 26 in the direction of the arrow 47 in FIG. 10. As previously mentioned, when member 30 pivots about fulcrum 52, teeth 40 on member 30 will move out of engagement with teeth 40*a* provided on threaded rod 26, thereby permitting free movement of the rod within through bore 22 with the threads on rod 26 sliding along the rearward most tooth 40 of member 30 (FIG. 10). Stated another way, when surface 50*a* of bottom wall 50 is spaced apart from the interior wall 24*a* of bore 24 in the manner shown in FIG. 10, teeth 40 provided on member 30 are disengaged from teeth 40*a* provided on rod 26. Conversely, when surface 50*a* of bottom wall 50 of member 30 is in a parallel relationship with wall 24*a* of bore 24 in the manner shown in FIG. 9, teeth 40 on member 30 will be moved into threadable engagement with teeth 40*a* provided on rod 26. With this highly novel construction, the work piece can be placed within the throat of the clamp and a manual force exerted on the outboard end of threaded rod 26 in the direction of the work piece. This force will cause swivel 23 to move rapidly into engagement with the work piece. When the inweard force in the direction of arrow 47 ceases, spring 36 will urge member back to its starting position (see FIG. 9) so that the work piece can then be securely clamped into position by a clockwise rotation of rod 26 using handle 26*a*.

Having now described the invention in detail in accordance with the requirements of the patent statutes, those skilled in this art will have no difficulty in making changes and modifictions in the individual parts or their relative assembly in order to meet specific requirements or conditions. Such changes and modifications may be made with out departing from the scope and spirit of the invention, as set forth in the following claims.

I claim:

1. An article clamping device comprising:

(a) a generally C-shaped frame having first and second end portions, said first end portion having:
  (i) a first bore; and
  (ii) a second bore extending angularly relative to said first bore;

(b) a threaded rod having an inboard end and an outboard end, said threaded rod being receivable within said first bore of said frame for movement between a first retracted position and a second extended position; and (c) control means for controlling movement of said threaded rod between said first and second positions, said control means comprising:
  (i) a control member disposed within said second bore of said frame for pivotal movement between a first rod engaging position and a second disengaged position, said control member comprising a body having a rod engaging surface provided with a plurality of tooth like protuberances; and
  (ii) biasing means for biasing said control member toward said engaged position, said control member being movable into said disengaged position against the urging of said biasing means by forces exerted on said outboard end of said threaded rod tending to urge said threaded rod in a direction toward said second extended position.

2. A device as defined in claim 1 in which said control member is provided with a counter bore and in which said biasing means comprises a coil spring disposed within said counter bore.

3. A device as defined in claim 1 in which said control member has a first surface, a second surface extending generally perpendicular to said first surface and a third surface interconnecting said first and second surfaces, said third surface having a plurality of spaced apart tooth like protuberances.

4. A clamping device for clamping a work piece comprising:

(a) a frame having first and second end portions said first end portion having:
  (i) a first bore having a central axis; and
  (ii) a second counter bore having a central axis disposed at an angle relative to said central axis of said first bore;

(b) an externally threaded rod having an inboard end and an outboard end, said threaded rod being receivable within said first bore of said frame for movement between a first retracted position and a second extended position;

(c) control means for controlling movement of said threaded rod, said control means comprising a control member disposed within said second boar of said frame for pivotal movement therewithin between a rod engaging position and a disengaged position, said control member having first and second, generally parallel end walls, said rod engaging surface extending between said first and second end walls and being provided with a plurality of tooth-like protuberances; and (d) biasing means for yieldably resisting movement of said control member into said disengaged position.

5. The device as defined in claim 4 in which said control member is movable into said disengaged position by:

(a) forces exerted on one of said end walls of said control member; and (b) by forces exerted on said outboard end of said threaded rod in a direction tending to move said threaded rod toward said extended position.

6. The device as defined in claim 4 in which said second bore extends at an acute angle with respect to said first bore.

7. A device as defined in claim 4 in which said control member includes a counter bore and in which said biasing means comprises a coil spring disposed within said counter bore.

8. A clamping device for clamping a work piece comprising:

a) a frame having first and second end portions said first end portion having:
  (i) a first bore; and
  (ii) a second bore extending angularly with respect to said first bore;

(b) a threaded rod having an inboard end and an outboard end, said threaded rod being receivable within said first bore of said frame for movement therewithin between a first retracted position and a second extended position;

(c) a control means for controlling movement of said threaded rod, said control means comprising a control member pivotally carried within said second bore of said frame for movement between a rod engaging position and a disengaged position, said control member having first and second end walls and a rod engaging surface disposed intermediate said first and second end walls, said rod engaging surface being provided with a plurality of tooth like protuberances and being movable into said disengaged position by:
  (i) forces exertion on one of said end walls; and
  (ii) by forces exerted on said outboard end of said threaded rod in a direction tending to move said threaded rod toward said extended position; and (d) biasing means for yieldably resisting movement of said control member toward said disengaged position.

9. A device as defined in claim 8 in which said control member includes a counter bore and in which said biasing means comprises a coil spring disposed within said counter bore.

10. A device as defined in claim 8 in which said second bore includes an inner surface and in which control member further includes a bottom wall interconnecting said first and second end walls, said bottom wall having first and second, angularly inclined surfaces, said first surface being in engagement with said inner surface of said second bore when said control member is in said rod engaging position.

11. A device as defined in claim 10 in which said first surface of said bottom wall of said control member is spaced apart from said inner surface of said second bore when said control member is in said disengaged position.

12. A device as defined in claim 11 in which said first and second, angularly inclined surfaces of said bottom wall of said control member join at a fulcrum, said control member being pivotally movable about said fulcrum upon a force being exerted on one of said end walls of said control member.

* * * * *